US008616158B2

(12) United States Patent
Garrett et al.

(10) Patent No.: US 8,616,158 B2
(45) Date of Patent: Dec. 31, 2013

(54) NON-DILUTION BLOWER APPARATUS FOR HIGH EFFICIENCY WATER HEATER

(75) Inventors: Michael K. Garrett, Cassville, MO (US); John Matukewicz, Cassville, MO (US)

(73) Assignee: Regal Beloit Amercia, Inc., Beloit, WI (US)

( * ) Notice: Subject to any disclaimer, the term of this patent is extended or adjusted under 35 U.S.C. 154(b) by 1161 days.

(21) Appl. No.: 12/474,583

(22) Filed: May 29, 2009

(65) Prior Publication Data

US 2010/0303646 A1 Dec. 2, 2010

(51) Int. Cl.
*F24H 1/00* (2006.01)

(52) U.S. Cl.
USPC ..... 122/18.31; 122/4 R; 415/213.1

(58) Field of Classification Search
USPC ..... 122/4 R, 13.01, 17.1, 18.31; 415/213.1, 415/214.1, 215.1; 417/360, 423.15, 423.1, 417/423.14
See application file for complete search history.

(56) References Cited

U.S. PATENT DOCUMENTS 5,352,099 A * 10/1994 Anstine et al. ..... 417/366
5,834,869 A * 11/1998 Morgan et al. ..... 310/89
6,231,311 B1 5/2001 Gatley et al.
6,398,512 B2 6/2002 Stewart
6,530,346 B1 3/2003 Coones et al.
6,557,501 B2 * 5/2003 Hughes ..... 122/13.01
6,602,058 B1 8/2003 Stewart
6,622,660 B1 9/2003 Bajic et al.
6,827,560 B2 12/2004 Gatley, Jr. et al.
6,951,241 B1 * 10/2005 Gatley ..... 165/47
7,780,405 B2 * 8/2010 Araki ..... 415/204
2001/0038794 A1 * 11/2001 Stewart ..... 417/53
2006/0065211 A1 * 3/2006 Hasbargen et al. ..... 122/17.1
2007/0147995 A1 * 6/2007 Araki ..... 415/204
2009/0211540 A1 8/2009 Yin et al.

* cited by examiner

*Primary Examiner* — John K Fristoe, Jr.
*Assistant Examiner* — Jessica Cahill
(74) *Attorney, Agent, or Firm* — Thompson Coburn LLP

(57) ABSTRACT

A blower housing of novel two-piece construction is comprised of first and second housing parts of stamped or drawn sheet metal that are attached together. The two-piece construction provides the housing with two interior portions separated by an interior wall. The interior wall has an opening that is spaced from the aligned exhaust opening of the heater and the output opening of the housing. This creates a winding exhaust gas flow path through the blower housing. The interior wall is also provided with a recessed cavity that receives a portion of a fan rotated by a motor supported by the blower housing. Positioning of at least a portion of the fan in the cavity reduces the overall height dimension of the blower housing and facilitates the retrofitting of the blower housing between an existing exhaust opening of a heater and an axially aligned flue pipe.

16 Claims, 6 Drawing Sheets

NON-DILUTION BLOWER APPARATUS FOR HIGH EFFICIENCY WATER HEATER

BACKGROUND OF THE INVENTION

1. Field of the Invention

The present invention pertains to a heater blower apparatus that is primarily intended for use as a non-dilution water heater blower. The apparatus is designed to be retrofit to an existing water heater between the axially aligned heater exhaust opening and a flue pipe.

2. Description of the Related Art

In the basic construction of a water heater, a fuel such as gas is burned in a combustion chamber of the water heater to heat water passed through the water heater. The water typically travels through a series of coils in the water heater. Combustion of the fuel in the combustion chamber produces hot combustion exhaust gas that passes through the series of coils and heats the water passing through the coils. The combustion exhaust gas then exits the water heater through an exhaust opening of the water heater and then passes through a flue pipe that conducts the gas out of the building containing the water heater.

Many prior art water heaters are connected to a flue pipe or chimney where only the draft effect of the flue pipe or chimney moves the exhaust gas up through the flue pipe or chimney. Because only the difference in temperature and pressure between the hot exhaust gas inside the water heater and the ambient air outside the water heater would cause the gas to move upwardly through the flue pipe or chimney, prior art water heaters were designed to avoid restricting the flow of the exhaust gas upwardly through the water heater to ensure that the gas would exit the water heater through the flue pipe or chimney. This limited the number of coils that could be positioned inside the water heater so as not to overly restrict the flow of the exhaust gas through the water heater. This in turn reduced the efficiency of the water heater.

To increase efficiency, water heaters have been designed where the hot gas of combustion is drawn through an increased number of coils of the water heater to provide an increased amount of heat transfer from the heat of the gas to the water passing through the coils. A greater number of coils enables a greater amount of heat transfer. However, this also required that the water heater be constructed with a blower apparatus that would draw the combustion gas through the coils of the water heater and to the flue pipe exhausting the gas.

The addition of a blower apparatus to a water heater increased the overall cost of the water heater. In addition, because the blower apparatus would draw the exhaust gas quickly through the water heater and into the blower apparatus, the increased temperature of the exhaust gas drawn into the blower apparatus often required that the blower apparatus mix ambient dilution air with the hot exhaust gas to cool the gas. The need to draw dilution air into the blower apparatus to cool the exhaust gas often required that the blower apparatus have a more complicated blower housing design and a more powerful motor for the fan of the apparatus. The more complicated blower housing design often increased the cost of manufacturing the blower apparatus, detracting from the energy savings of the dilution blower apparatus. The energy used by the more powerful motor also would negate some of the energy savings realized by increasing the heat transfer between the combustion gas and the coils of the water heater.

SUMMARY OF THE INVENTION

What is needed to overcome the problems experienced with prior art blower apparatus employed with water heaters is a blower apparatus having a more simplified housing construction that can be manufactured inexpensively. In addition, the blower apparatus should be a non-dilution type to avoid the increased cost of a more complicated blower housing design and a more powerful motor for the apparatus. With the apparatus being non-dilution, the apparatus housing should be able to withstand the increased heat of combustion exhaust gas drawn into the housing. Furthermore, the blower housing construction must enable the apparatus to be retrofit between an existing heater exhaust opening and an existing flue pipe that exhausts the combustion gas of the heater. Still further, to facilitate retrofitting the heater blower apparatus between an existing heater exhaust opening and flue pipe, the vertical height dimensions of the blower housing must be minimized. Although it is necessary that the blower housing have a limited height dimension, it is also desirable that the blower housing restrict the free flow of heat from the water heater up through the exhaust flue pipe when the water heater is in a standby mode and water is not circulating through the water heater.

The heater blower apparatus of the present invention is designed to be retrofit to a heater, for example a water heater, between the existing heater exhaust opening and a flue pipe. The apparatus has a blower housing of novel construction that facilitates the insertion of the apparatus between an axially aligned heater exhaust opening and a flue pipe. In addition, the novel construction of the blower housing has an interior exhaust gas flow path that changes direction as it extends through the interior of the blower housing, and thereby significantly reduces standby energy losses from the water heater.

The blower housing in the preferred embodiment is a non-dilution blower housing constructed of only two parts. Also in the preferred embodiment, a first part and a second part of the blower housing are formed of stamped or drawn sheet metal, thereby reducing their cost of manufacture and providing a non-dilution blower housing that can withstand the increased heat of combustion gas drawn into the housing. The first part of the housing is formed with one side positioned in a single plane that facilitates the mounting and sealing of the one side on an exterior surface of a heater such as a water heater. The first part of the housing is also dimensioned to extend over the exhaust opening of the water heater, positioning the exhaust opening in the interior of the first part of the housing. There are no dilution openings or vent openings to the housing first part. This maximizes the ability of the blower housing to generate a negative pressure to draw exhaust gases through the heater and into the blower housing.

The housing second part is designed to be attached on top of the housing first part, thereby completing the construction of the blower housing. The housing second part can be attached to the housing first part by threaded fasteners, by sealants or adhesives, or by other equivalent means. With the housing second part attached on top of the housing first part, the assembled blower housing encloses an interior having internal structure that creates a winding exhaust gas flow path through the blower housing. The construction of the housing second part includes the output opening of the blower housing. The output opening is generally positioned axially above and at least partially overlaps the heater exhaust opening when the blower housing is assembled to the exterior of the heater over the exhaust opening flue.

The internal structure of the blower housing includes an interior wall that is formed by the housing first part. The interior wall extends through the blower housing interior and divides the interior into a first portion that communicates with the heater exhaust opening and a second portion that communicates with the blower housing output opening. An additional opening is provided through the interior wall. The additional opening is spaced out of alignment with the heater exhaust opening and the blower housing output opening, thereby creating the winding path of exhaust gas flow through the blower housing interior.

The interior wall is also formed with a recessed cavity. The opening through the interior wall is positioned in the recessed cavity. The recessed cavity is dimensioned to receive at least a portion of a fan inside the cavity. This enables the blower housing to contain the fan in the interior of the blower housing while also enabling a reduction in the overall vertical height dimension of the blower housing on the exterior surface of the heater.

The second part of the blower housing supports a motor. The motor is positioned on the housing second part with a shaft of the motor extending into the blower housing to the fan contained in the blower housing interior. Operation of the motor rotates the fan in the blower housing. Rotation of the fan draws exhaust gas through the heater exhaust opening, then through the first portion of the blower housing interior, then through the opening in the blower housing interior wall to the fan, and then pushes the exhaust gas through the second portion of the blower housing interior to the output opening of the blower housing. The gas is then forced through the blower housing output opening to the flue pipe connected to the blower housing.

The circuitous or winding path of the exhaust gas through the interior of the blower housing reduces standby losses from the heater to which the blower apparatus is attached. In addition, a damper could be added to the interior of the blower housing to further reduce standby losses of the heater.

Thus, the novel construction of the blower housing of the invention enables the positioning of an interior wall in the blower housing to create the winding path for exhaust gas flow to reduce standby losses, and also enables positioning the fan in the blower housing while limiting the vertical height dimension of the blower housing.

Furthermore, the novel construction enables the blower housing to be retrofit or assembled to an exterior surface of a heater over the exhaust opening of the heater and between the existing exhaust opening and a flue pipe.

Still further, the desirable features of the blower housing are attained by providing a housing of only two-piece construction that in the preferred embodiment are stamped or drawn from metal sheet, thereby reducing the overall costs involved in the construction of the blower housing.

DESCRIPTION OF THE DRAWINGS

Further features of the heater blower apparatus of the invention are set forth in the following detailed description of the preferred embodiment of the apparatus and in the drawing figures.

DETAILED DESCRIPTION OF THE PREFERRED EMBODIMENT

Figure 2:
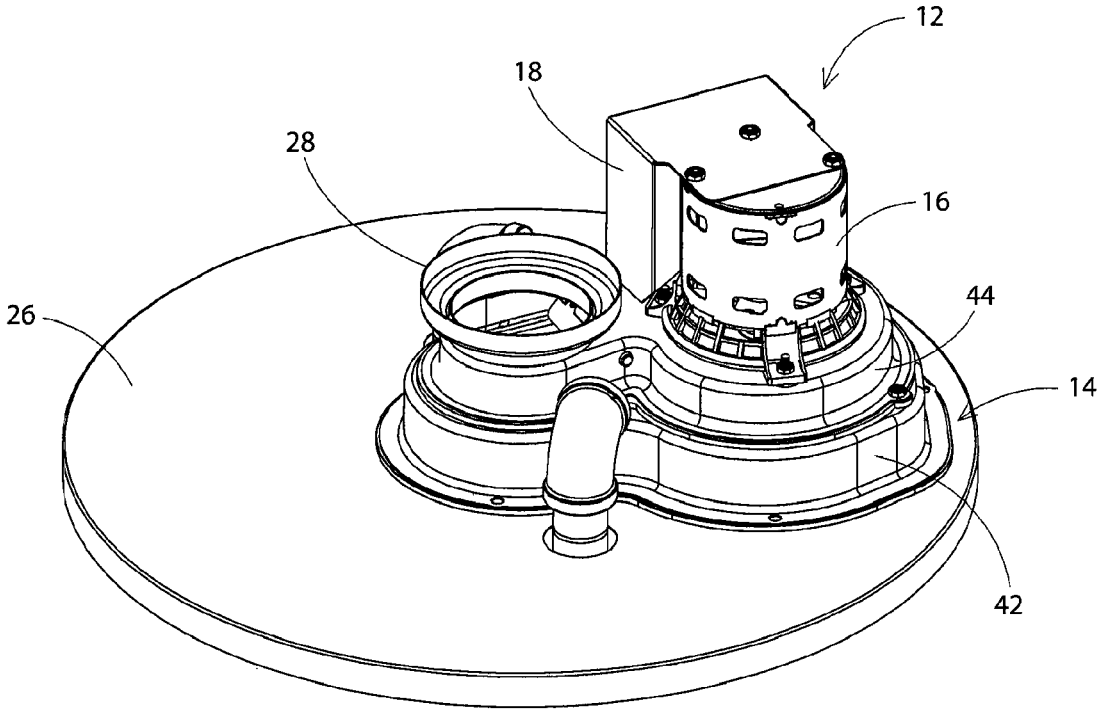
FIG. 2 is a top perspective view of the apparatus and heater exterior surface shown in FIG. 1 with the flue pipe removed.
Figure 1:
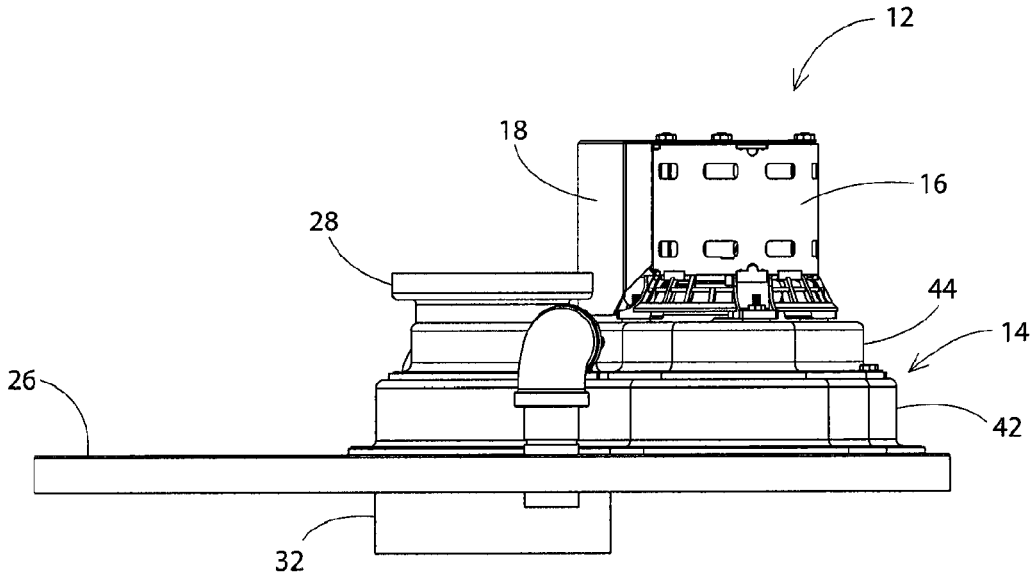
FIG. 1 is a side elevation view of the heater blower apparatus of the invention assembled between an existing heater exhaust opening on an exterior surface of a heater and a flue pipe.
Figure 3:
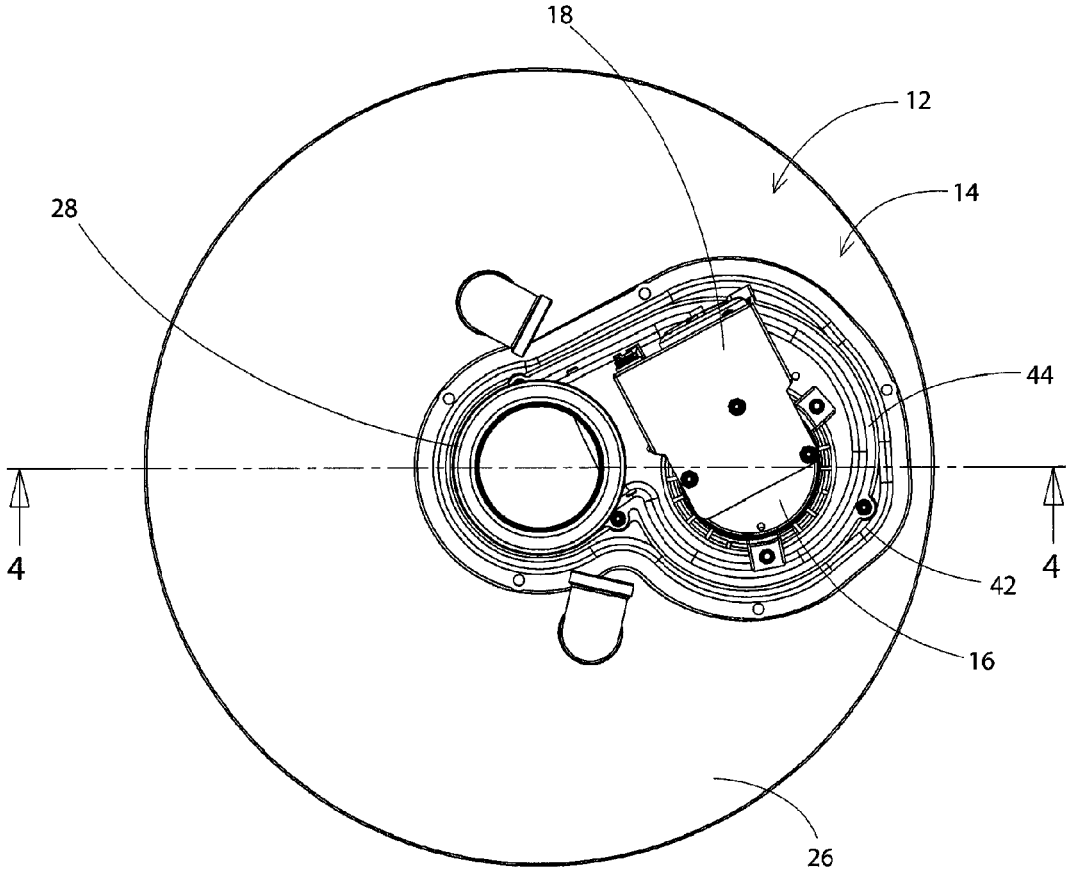
FIG. 3 is a top plan view of the blower apparatus and the heater exterior surface.
Figure 4:
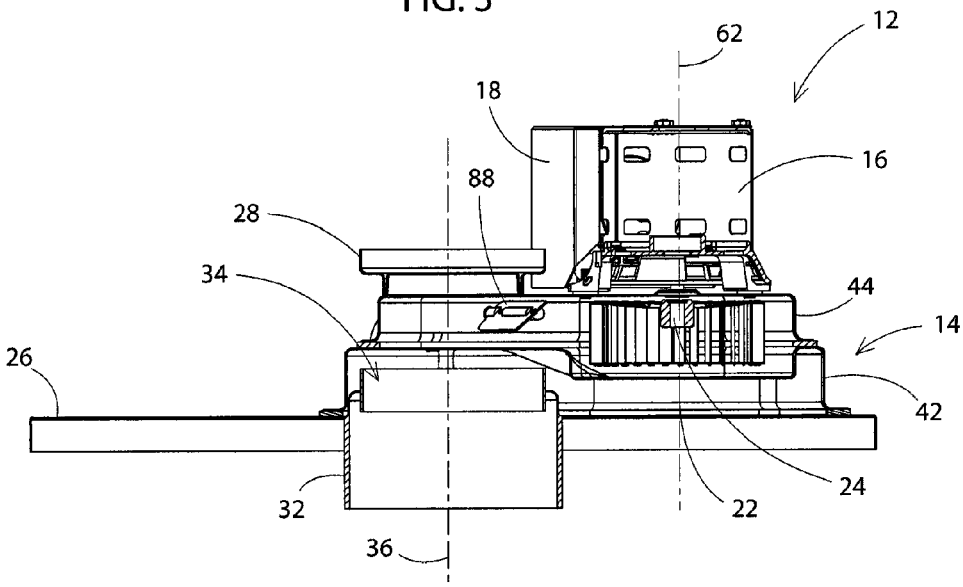
FIG. 4 is a view of the apparatus similar to that of FIG. 1, but shown as a cross-section in the plane of line 4-4 of FIG. 3.

The heater blower apparatus 12 of the present invention is primarily designed for use on a conventional water heater and has a simplified, inexpensive two-piece blower housing 14. Although primarily designed for use on top of a water heater, the concepts of the apparatus 12 may be employed on other similar types of heaters. To enable the blower apparatus to be retrofit to an existing water heater, the apparatus is designed with a unique blower housing 14 that has a reduced vertical height dimension and is capable of being inserted between an existing exhaust opening of the water heater and an axially aligned flue pipe. The blower housing 14 also has a winding exhaust gas flow path through the interior of the housing that allows the exhaust gas to cool as it flows through the housing, thereby enabling the apparatus to be a non-dilution blower apparatus. In addition, the winding exhaust gas flow path through the housing interior reduces standby losses of the water heater.

In addition to the novel two-piece construction of the blower housing 14, the heater blower apparatus 12 of the invention also comprises an electric motor 16 and its associated circuitry 18, and a fan 22 connected to an output shaft 24 of the motor for rotation of the fan with the output shaft. Because the blower apparatus 12 is a non-dilution blower apparatus, the motor 16 employed with the apparatus is a smaller, more energy efficient motor than those typically employed in dilution blower apparatus. Apart from this, the motor 16, the motor circuitry 18, and the fan 22 of the heater blower apparatus 12 are for the most part conventional and their details will not be further described herein.

Furthermore, the water heater 26 and the exhaust gas flue pipe 28 with which the apparatus 12 is designed to be used are of a conventional construction. The water heater is represented by the top flat exterior surface 26 of the water heater shown in FIGS. 1, 2, 3 and 4. The water heater 26 shown has an exhaust pipe 32 that surrounds an exhaust opening 34 of the heater. The exhaust opening 34 has a center axis 36 that is coaxial with a center axis of the flue pipe 28. Because the water heater and the exhaust gas flue pipe are conventional apart from the center axis 36 of the water heater exhaust opening 34 and the center axis 36 of the flue pipe 28 being coaxial, the details of the constructions of the water heater and flue pipe will not be further described herein.

The two-piece construction of the blower housing 14 basically consists of a first part 42 and a second part 44. Both parts in the preferred embodiment of the application are constructed entirely of sheet metal. To reduce the manufacturing costs of the two parts 42, 44, in the preferred embodiment both parts 42, 44 are formed of stamped or drawn sheet metal.

The housing first part 42 is designed to be attached directly to the exterior surface 26 of the water heater with the first part 42 extending around and sealing around the water heater exhaust opening 34. This defines the blower housing 14 as a non-dilution blower housing. With the housing first part 42 attached to the water heater exterior surface 26, the center axis 36 of the heater exhausts opening 34 defines mutually perpendicular axial and radial directions relative to the housing first part 42.

The housing first part 42 is provided with a bottom flange 46 that projects radially outwardly from the bottom of the housing first part 42 and extends completely around the housing first part 42. The flange 46 is positioned in a single plane that enables the flange to be securely attached to the flat exterior surface 26 of the water heater. The flange 46 can be attached to the heater exterior surface 26 by threaded fasteners, by spot welds or rivets, by adhesives, or by other equivalent means of attachment. Thus, the flange 46 surrounds and defines an input opening into the interior of the housing first part 42, which is also a first portion of the interior 48 of the two-piece blower housing 14. In alternate embodiments, the housing first part 42 could be provided with a bottom wall that extends entirely across the input opening of the first part 42. Such a bottom wall would include at least one opening that would accommodate the water heater exhaust pipe 32 and the exhaust opening 34 when the housing first part 42 is attached to the water heater exterior surface 26.

The housing first part 42 is also formed with a first part side wall 52 that extends axially upwardly from a radially inner edge of the housing first part bottom flange 46. The housing first part side wall 52 extends completely around the interior 48 of the housing first part 42 and is a continuous extension from the housing first part bottom flange 46 with there being no openings, separations, etc. between the housing first part bottom flange 46 and the housing first part side wall 52. As shown in the drawing figures, the axial height dimension of the housing first part side wall 52 is sufficient to extend vertically beyond the top edge of the water heater exhaust pipe 32.

Figure 5:
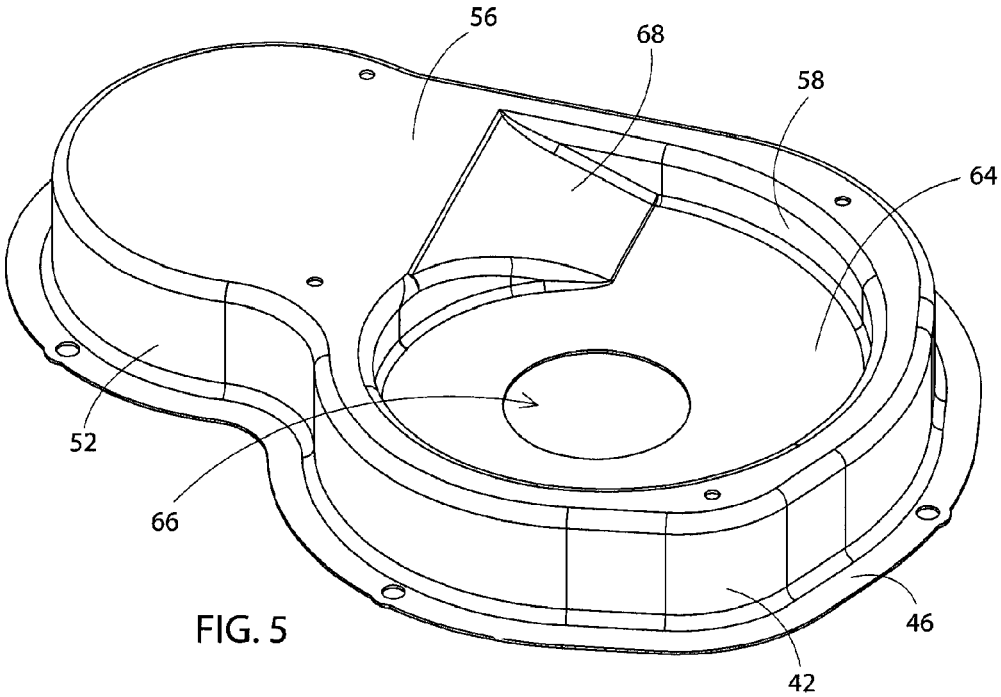
FIG. 5 is a top perspective view of the blower housing first part removed from the blower apparatus and heater.
Figure 6:
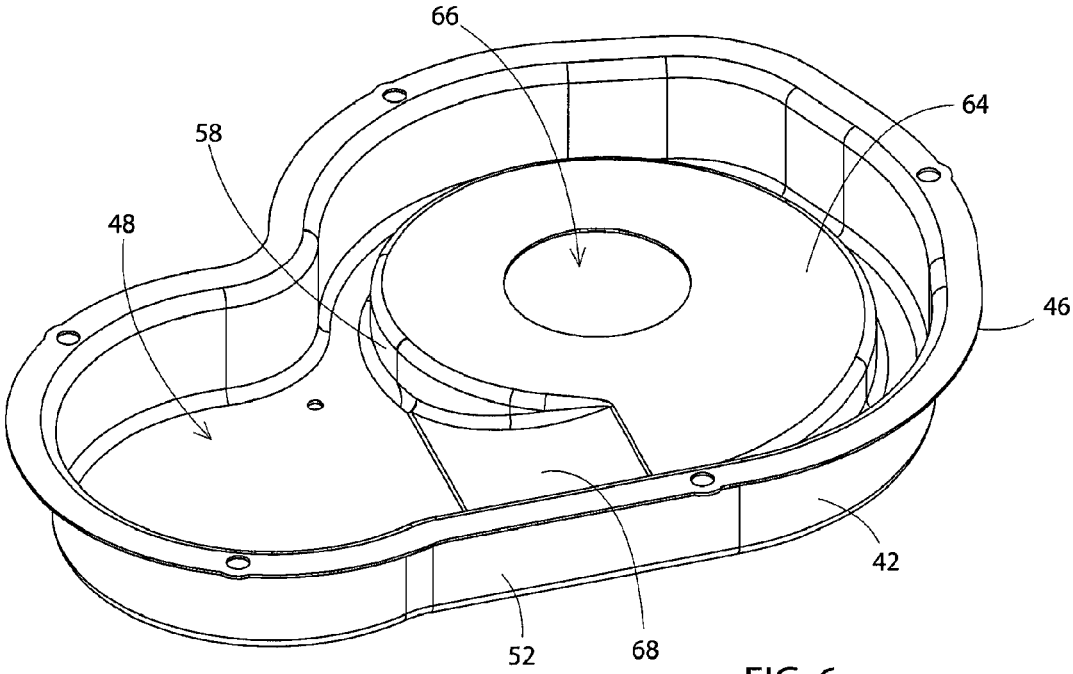
FIG. 6 is a bottom perspective view of the blower housing first part.
Figure 7:
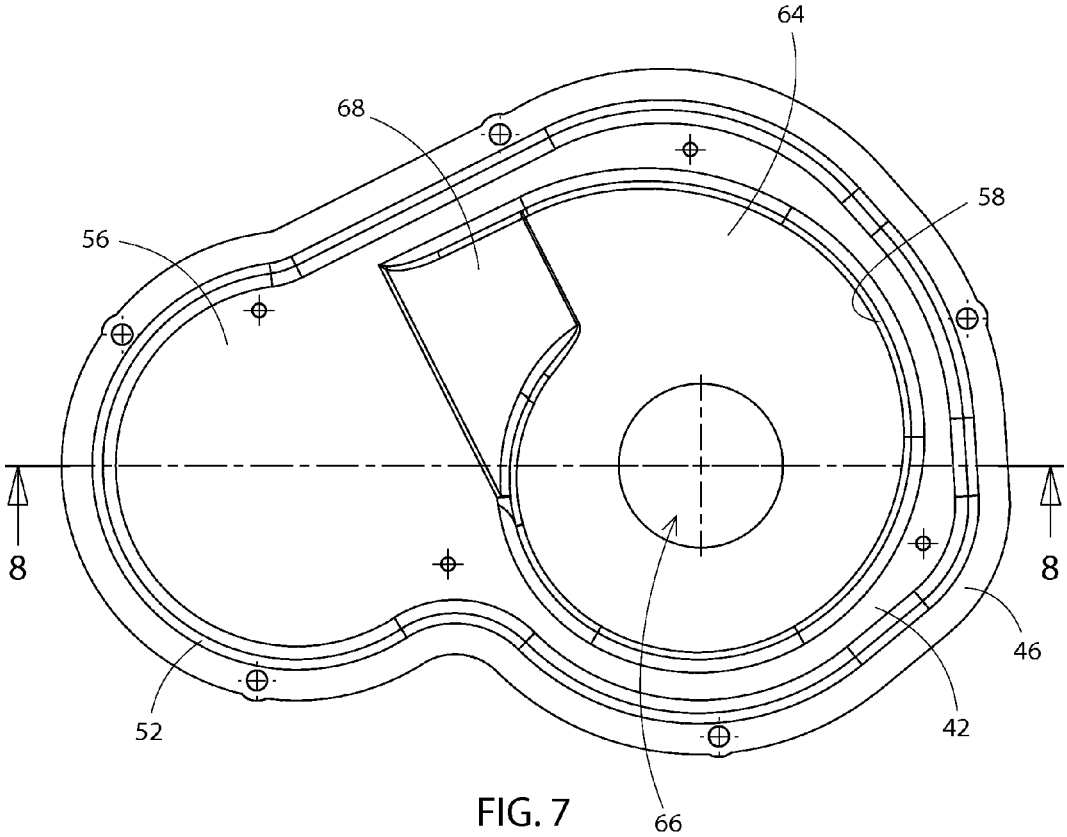
FIG. 7 is a top plan view of the blower housing first part.
Figure 8:
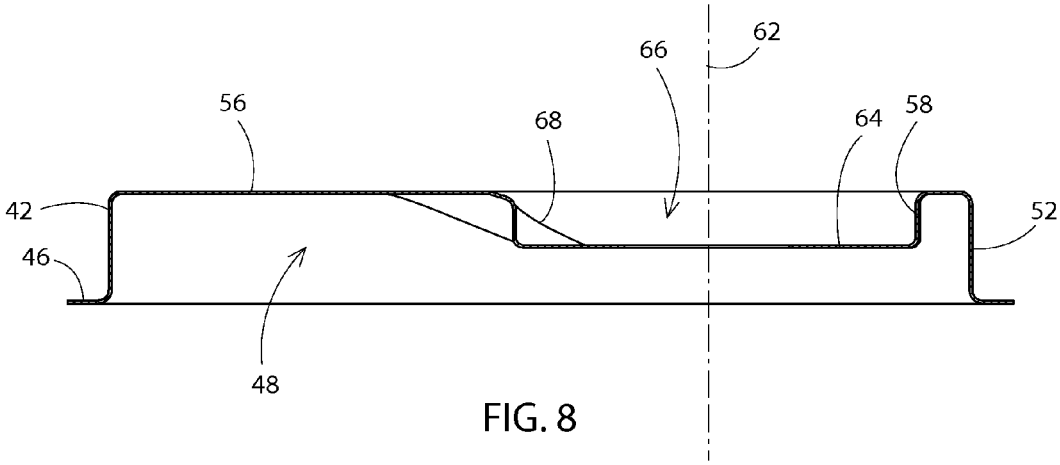
FIG. 8 is a cross-section view of the blower housing first part in the plane of line 8-8 shown in FIG. 7.
Figure 9:
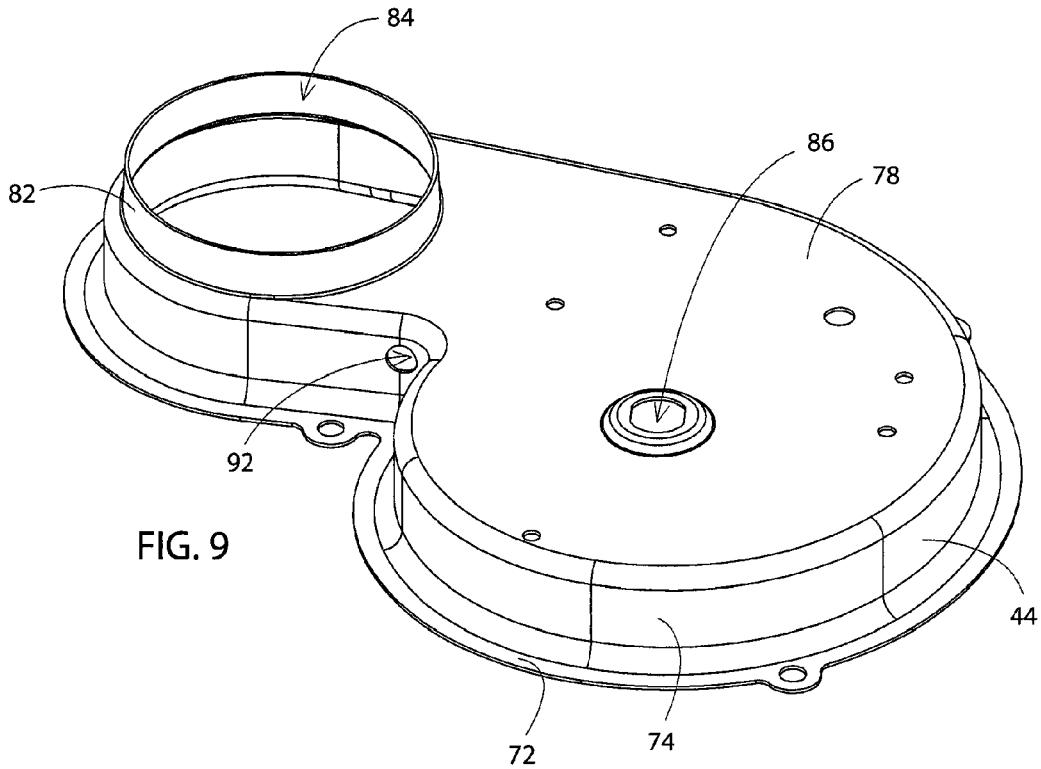
FIG. 9 is a top perspective view of the blower housing second part removed from the blower apparatus and the heater.
Figure 10:
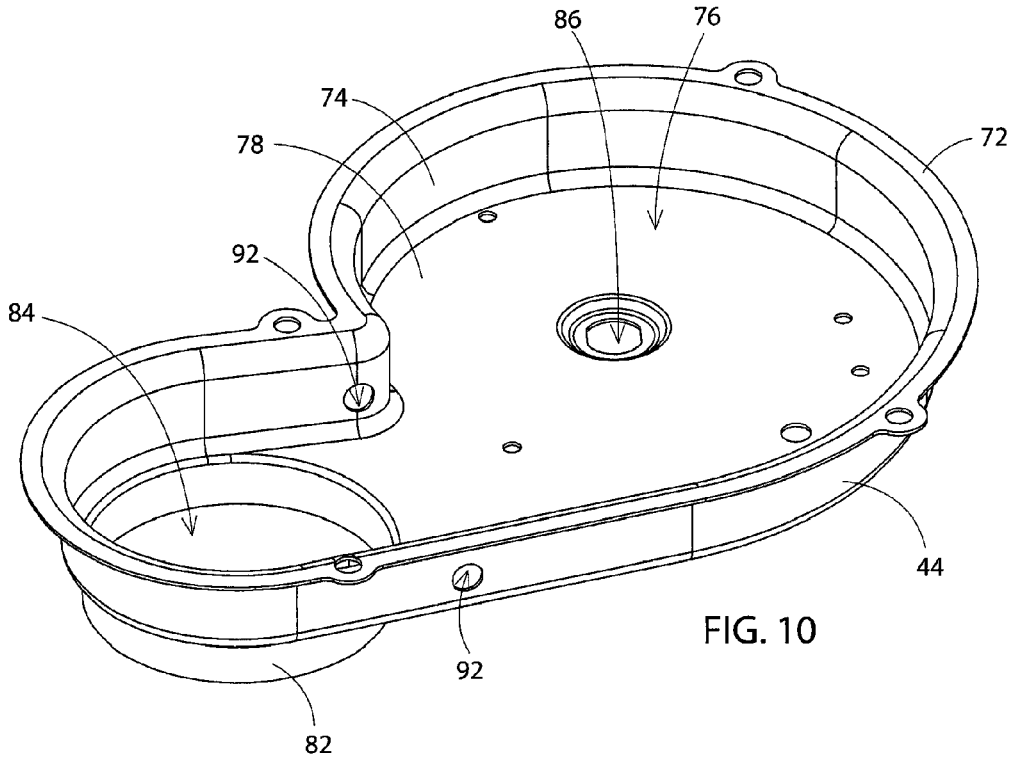
FIG. 10 is a bottom perspective view of the blower housing second part.
Figure 11:
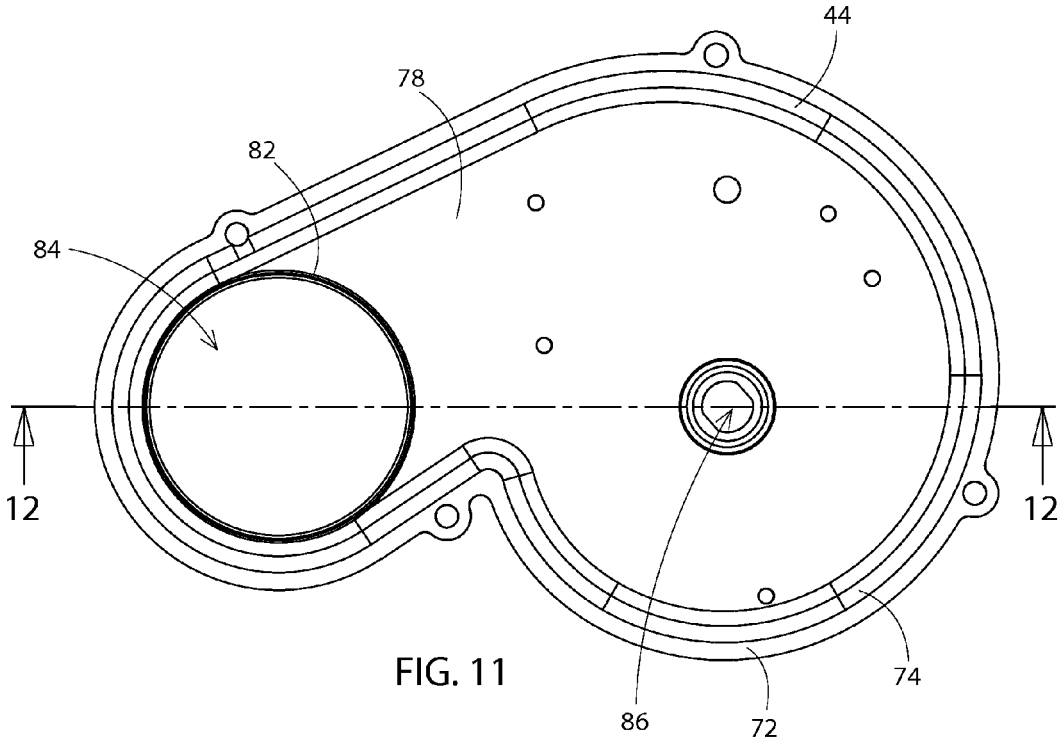
FIG. 11 is a top plan view of the blower housing second part.
Figure 12:
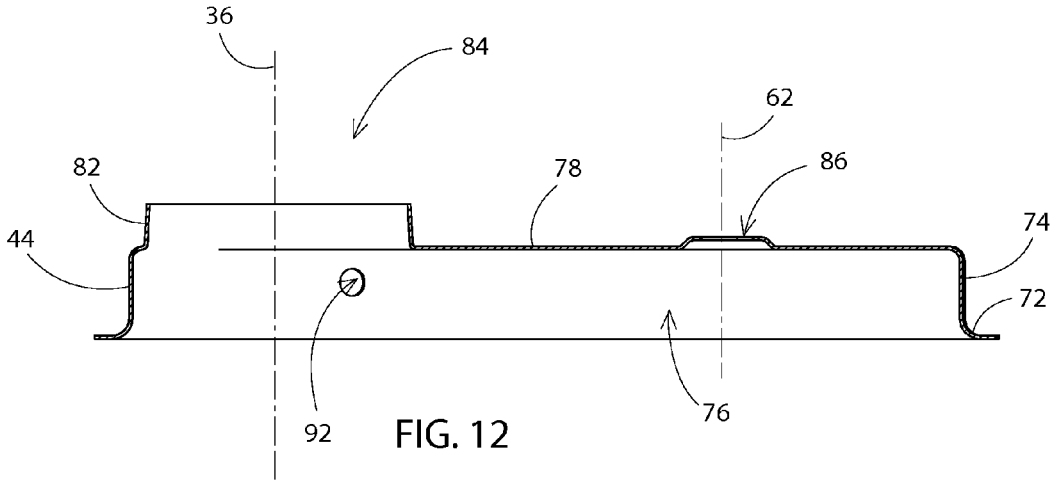
FIG. 12 is a cross-section view of the blower housing second part in the plane of line 12-12 shown in FIG. 11.

The housing first part 42 also includes a first part top wall 56 that extends radially inwardly from the top edge of the housing first part side wall 52. The housing first part top wall 56 is a continuous extension from the housing first part side wall 52 with there being no openings, separations, etc. between the housing first part top wall 56 and housing first part side wall 52. Thus, the housing first part side wall 52 completely surrounds the housing first part top wall 56. Much of the housing first part top wall 56 is formed as a flat surface that is parallel with the plane of the housing first part bottom wall flange 46. A portion of the housing first part top wall 56 is formed as a volute-shaped cavity defined by a spiral cavity side wall 58. The cavity side wall 58 has a radial dimension that is slightly larger than the diameter dimension of the fan 22 circumference of rotation. As shown in the drawing figures, the cavity side wall 58 extends axially from the housing first part top wall 56 into the housing first part interior 48 toward the housing first part bottom wall flange 46. The cavity side wall 58 spirals around an axis 62 that is parallel to, but spaced radially from the heater exhaust opening axis 36 when the blower housing 12 is attached to the heater exterior surface 26. The cavity side wall 58 extends axially into the housing first part interior 48 to a flat cavity bottom wall 64. A circular first opening 66 passes through the housing first part top wall 56 at the center of the flat cavity bottom wall 64. The circular first opening 66 has a center axis 62 that is coaxial with the cavity side wall axis 62. The cavity bottom wall opening 66 is the only opening through the housing first part 42, except for any fastener openings that may be provided through the housing first part bottom wall flange 46 for attaching the housing first part 42 to the heater exterior surface 26. The cavity bottom wall also has a sloped portion 68 that slopes downwardly from the housing first part top wall 56 to the flat cavity bottom wall 64 as shown in FIGS. 5, 7, and 8.

The housing second part 44 is also formed with a second part bottom wall flange 72 that projects radially outwardly from the housing second part 44 and is positioned in a single horizontal plane. The housing second part bottom wall flange 72 has a configuration that follows, or is similar to the configuration of the housing first part side wall 52 and is dimensioned slightly smaller than the housing first part side wall 52. This enables the housing second part bottom wall flange 72 to be attached to the housing first part top wall 56 with the second part flange 72 positioned radially just inside of the housing first part side wall 52. The housing second part bottom flange 72 can be attached to the housing first part top wall 56 by threaded fasteners, by spot welds or rivets, by adhesives, or by other equivalent means of attachment.

The housing second part 44 also has a second part side wall 74 that extends axially upwardly from an inner edge of the housing second part bottom flange 72. The housing second part side wall 74 is continuous with the housing second part bottom flange 72 and extends completely around the housing second part bottom flange 72 with there being no openings, interruptions, etc. between the housing second part bottom flange 72 and the housing second part side wall 74. The housing second part side wall 74 extends completely around the interior of the housing second part 44, and surrounds a second portion of the interior 76 of the two-piece blower housing 14. As seen in the drawing figures, the axial dimension or vertical height of the housing second part side wall 74 is approximately the same as that of the housing first part side wall 52. In an alternate embodiment of the blower housing, the housing second part side wall 74 is attached directly to the housing first part 42 with the housing second part 44 not having the second part flange 72.

The housing second part 44 is also formed with a second part top wall 78 that extends radially inwardly from the top edge of the second part side wall 74. The second part top wall 78 is a continuous extension of the second part side wall 74 and the second part side wall 74 completely surrounds the second part top wall 78. Much of the second part top wall 78 is a flat planar surface that is parallel with the plane of the second part bottom flange 72, the plane of the housing first part top wall 56, and the plane of the housing first part bottom flange 46. A portion of the housing second part top wall 78 is formed as a cylindrical output rim 82 that extends axially upwardly from the second part top wall 78. The output rim 82 surrounds a second opening or an output opening 84 of the blower housing 14. The output opening 84 is circular and has a center axis 36 that is at least generally parallel to, and preferably is coaxial with the heater exhaust opening axis 36 when the apparatus 12 is attached to the heater exterior surface 26. In many applications, the output opening 84 is positioned generally axially above and at least partially overlaps the heater exhaust opening 34. In addition, the second part output opening axis 36 is spaced radially from and is parallel with the center axis 62 of the housing first part first opening 66. The housing second part output rim 82 has a circumferential dimension or a diameter dimension that is complementary to the respective circumferential dimension or diameter dimension of a flue pipe 28 or of an adapter connected to the flue pipe.

In addition to the output opening 84 through the housing second part top wall 78, the second part top wall 78 has a shaft opening 86 therethrough. The shaft opening 86 is positioned on the second part top wall 78 where a center axis of the shaft opening 86 is coaxial with the axis 62 of the housing first part first opening 66. The housing second part output opening 84 and the shaft opening 86 are typically the only openings through the housing second part 44. When the blower housing 14 includes an optional damper 88 in the housing second part 44 to further reduce stand-by losses, an additional pair of holes 92 could be provided in the second part side wall 74 to mount the damper 88 for pivoting movement. These additional holes 92 could be sealed to avoid reducing the draw of the blower housing 14.

The motor 16 is attached to the top wall 78 of the housing second part 44 with the motor shaft 24 extending through the shaft opening 86 and into the housing interior. The fan 22 is connected to the motor shaft 24 and is positioned in the blower housing interior between the housing first part top wall 56 and the housing second part top wall 78. The fan 22 has an axis of rotation that is coaxial with the axis 62 of the cavity bottom wall opening 66. As shown in the drawing figures, the axial dimension of the fan 22 extends into the cavity defined by the cavity side wall 58 in the housing first part top wall 56. Thus, at least a portion of the axial length of the fan 22 is received inside the cavity defined by the cavity side wall 58 of the housing first part top wall 56. This enables the fan 22 to be completely contained inside the blower housing 14 while also reducing the vertical height dimension of the blower housing 14. This also enables the blower housing 14 to be attached to the heater exterior surface 46 between the existing water heater flue 28 and exhaust opening 32 and an existing flue pipe 34.

The construction of the two-piece blower housing 14 described above also enables the apparatus 12 to be assembled or retrofit to an existing water heater 26 between the exhaust pipe 32 and exhaust opening 34 of the water heater 26 and an axially aligned existing flue pipe 28.

Still further, the construction of the two-piece blower housing 14 described above creates a winding exhaust gas flow path through the blower housing. On operation of the motor 16 and rotation of the fan 22 in the blower housing, exhaust gas is drawn axially through the water heater exhaust pipe 32 and the exhaust opening 34. The exhaust gas then travels radially from the water heater exhaust opening 34 toward the housing first part cavity side wall 58. The exhaust gas is then directed axially along the exterior of the housing first part cavity side wall 58. The exhaust gas then travels radially across the housing first part cavity bottom wall 64 toward the first opening 66 at the center of the cavity bottom wall 64. The exhaust gas then flows axially through the cavity bottom wall opening 66 toward the center of the rotating fan 22. The exhaust gas is then pushed radially by the rotating fan 22 through the fan circumference of rotation across the sloped portion 68 of the cavity bottom wall and toward the second housing opening 84, i.e. the output opening in the housing second part 44. The exhaust gas is then directed axially through the output opening 84 and into the flue pipe 28. The winding flow path of the exhaust gas through the two-piece blower housing 14 allows the gas to cool as it passes through the housing. In addition, the winding exhaust gas flow path through the blower housing 14 reduces stand-by losses of the water heater 26. To further reduce stand-by losses, the blower housing second part 44 could be modified with the damper 88 in the interior of the housing second part 44. The winding flow path of the exhaust gas through the blower housing is achieved inexpensively by the novel and non-obvious two-piece construction of the blower housing.

The heater blower apparatus 12 of the invention described above, when equipped with a properly designed water heater can achieve an energy factor (EF) of 0.67, which is the new Energy Star mandate going into effect in the United States on Sep. 1, 2010. The EF of 0.67 can be accomplished while meeting category 1 vent pipe applications (non-condensing and non-pressurized) so that the end user of the apparatus 12 can use an existing vent pipe.

The heater blower apparatus 12 of the invention described above can replace current atmospheric draft hood water heaters, which cannot meet the EF of 0.67 level.

The embodiments of the non-dilution blower apparatus were chosen and described in order to best explain the principles of the invention and its practical application to thereby enable others skilled in the art to best utilize the invention in various embodiments and with various modifications as are suited to the particular use contemplated.

As various modifications could be made in the constructions herein described and illustrated without departing from the scope of the invention, it is intended that all matter contained in the foregoing description or shown in the accompanying drawings shall be interpreted as illustrative rather than limiting. For example, the two pieces of the blower housing could be constructed of materials other than stamped or drawn sheet metal, and the blower housing could be employed on a heater other than a water heater. Thus, the breadth and scope of the present invention should not be limited by any of the above-described exemplary embodiments, but should be defined only in accordance with the following claims appended hereto and their equivalents.

What is claimed is:

1. A heater blower apparatus that is attachable to an exterior surface of a heater having an exhaust opening on the exterior surface with the exhaust opening having a center axis that defines mutually perpendicular axial and radial directions relative to the heater, the apparatus comprising:

a motor, the motor having a shaft that is rotated on operation of the motor, the shaft having an axis of rotation that defines mutually perpendicular axial and radial directions relative to the apparatus;

a fan connected to the motor shaft for rotation of the fan with rotation of the motor shaft, the fan having an axis of rotation and a circumference of rotation;

a blower housing having an interior containing the fan, the motor being supported by the blower housing with the motor shaft extending into the interior of the blower housing to the fan contained inside the blower housing interior, the blower housing having an output opening that communicates the blower housing interior with an exterior environment of the blower housing and is positioned on the blower housing at a radially spaced position from the fan contained in the blower housing interior, the blower housing output opening having a center axis, and the blower housing being attachable to the heater exterior surface with the heater exhaust opening contained inside the blower housing interior in a manner such that a center axis of the heater exhaust opening is substantially coaxial with the center axis of the blower housing output opening and with interior structure of the blower housing together with the heater exhaust opening and heater exterior surface defining an exhaust gas flow path that extends axially from the heater exhaust opening into the blower housing interior volume, then extends radially through the blower housing interior toward the fan, then extends axially through the blower housing interior outside of the fan circumference of rotation, then extends radially through the blower housing interior toward the motor shaft axis of rotation, then extends axially through the blower housing interior and into the fan circumference of rotation, then extends radially through the blower housing interior away from the motor shaft axis of rotation and through the fan circumference of rotation toward the blower housing output opening, and then extends axially through the blower housing interior and axially through the blower housing output opening to the exterior environment of the blower housing.

2. The apparatus of claim 1, further comprising:

the center axis of the blower housing output opening being substantially parallel to and spaced radially from the motor shaft axis of rotation and the fan axis of rotation and the output opening being positioned axially above the heater exhaust opening when the blower housing is attached to the heater exterior surface.

3. The apparatus of claim 1, further comprising:

the blower housing being attachable to the heater exterior surface to prevent dilution air from entering the blower housing interior.

4. The apparatus of claim 1, further comprising:

the blower housing being attachable to the heater exterior surface with the blower housing sealing around the heater exhaust opening and thereby providing a non-dilution air blower housing on the heater.

5. The apparatus of claim 1, further comprising:

the interior structure of the blower housing including an interior wall that extends radially through the blower housing interior and is positioned axially between the heater exhaust opening and the blower housing output opening when the blower housing is attached to the heater exterior surface.

6. The apparatus of claim 5, further comprising:

the interior wall having an opening through the interior wall that is spaced radially and axially from the blower housing output opening and is spaced radially and axially from the heater exhaust opening when the blower housing is attached to the heater exterior surface.

7. The apparatus of claim 6, further comprising:

the exhaust gas flow path passing through the interior wall opening.

8. The apparatus of claim 6, further comprising:

the interior wall opening being axially aligned with the fan axis of rotation.

9. The apparatus of claim 6, further comprising:

the fan being positioned on one side of the interior wall and the heater exhaust opening being positioned on an opposite side of the interior wall when the blower housing is attached to the heater exterior surface.

10. A heater blower apparatus that is attachable to an exterior surface of a heater having an exhaust opening on the exterior surface and the exhaust opening having a center axis that defines mutually perpendicular axial and radial directions relative to the heater, the apparatus comprising:

a motor, the motor having a shaft that is rotated on operation of the motor, the shaft having an axis of rotation that defines mutually perpendicular axial and radial directions relative to the apparatus;

a fan connected to the motor shaft for rotation of the fan with rotation of the motor shaft, the fan having an axis of rotation that is substantially parallel with the motor shaft axis of rotation; and, a blower housing having an interior containing the fan, the blower housing supporting the motor with the motor shaft extending into the blower housing interior to the fan contained in the blower housing interior, the blower housing being attachable to the heater exterior surface with the heater exhaust opening contained in the blower housing interior and with the exhaust opening center axis being radially spaced from the motor shaft axis of rotation and the fan axis of rotation, and the blower housing having an output opening that communicates the blower housing interior with an exterior environment of the blower housing, the blower housing output opening having a center axis that is spaced radially from the motor shaft axis of rotation and the fan axis of rotation and is substantially coaxial with a center axis of the heater exhaust opening with the output opening being positioned axially above the heater exhaust opening when the blower housing is attached to the heater exterior surface.

11. The apparatus of claim 10, further comprising:

the motor shaft axis of rotation and fan axis of rotation being substantially coaxial and substantially parallel to the blower housing output opening axis and the heater exhaust opening center axis.

12. The apparatus of claim 11, further comprising:

the blower housing being attachable to the heater exterior surface to prevent dilution air from entering the blower housing interior.

13. The apparatus of claim 11, further comprising:

the blower housing being attachable to the heater exterior surface with the blower housing sealing around the heater exhaust opening and thereby providing a non-dilution air blower housing on the heater.

14. The apparatus of claim 11, further comprising:

the blower housing having an interior wall that extends radially through the blower housing interior and is positioned axially between the blower housing output opening and the heater exhaust opening when the blower housing is attached to the heater exterior surface.

15. The apparatus of claim 14, further comprising:

the interior wall having an opening with a center axis that is substantially coaxial with the fan axis of rotation.

16. The apparatus of claim 14, further comprising:

the fan being positioned on one side of the interior wall and the heater exhaust opening being positioned on an opposite side of the interior wall when the blower housing is attached to the heater exterior surface.

* * * * *